United States Patent [19]

Palmer et al.

[11] 4,061,369

[45] Dec. 6, 1977

[54] CATCHES

[75] Inventors: John P. Palmer, Reading; Stephen W. Isbister, Maidenhead; John D. F. Elvin, Wokingham, all of England

[73] Assignee: ITW Limited, Slough, England

[21] Appl. No.: 587,763

[22] Filed: June 17, 1975

[30] Foreign Application Priority Data

July 8, 1974 United Kingdom ..... 30170/74

[51] Int. Cl.[2] ..... E05C 1/08

[52] U.S. Cl. ..... 292/163; 292/DIG. 38; 292/DIG. 61

[58] Field of Search ..... 292/2, 70, 74, 76, 137, 292/163, 164, 169, 169.19, 170, DIG. 38, DIG. 61, 166, 168, 224, 227

[56] References Cited

U.S. PATENT DOCUMENTS

| | | | |
|---|---|---|---|
| 1,859,003 | 5/1932 | Ragan | 292/74 X |
| 2,266,119 | 12/1941 | Jacobi | 292/227 |
| 3,479,075 | 11/1969 | Swanno | 292/DIG. 38 |
| 3,652,113 | 3/1972 | Odend'hal et al. | 292/227 X |
| 3,724,888 | 4/1973 | James | 292/DIG. 38 |
| 3,825,289 | 7/1974 | Armstrong | 292/163 |
| 3,918,754 | 11/1975 | Isbister | 292/DIG. 38 |

FOREIGN PATENT DOCUMENTS

| | | | |
|---|---|---|---|
| 270,947 | 1/1930 | Italy | 292/70 |
| 915,475 | 1/1963 | United Kingdom | 292/DIG. 38 |

*Primary Examiner*—Richard E. Moore

*Attorney, Agent, or Firm*—Jack R. Halvorsen; Robert W. Beart

[57] ABSTRACT

A catch comprising a plunger member and a guide member, the plunger member being able to reciprocate in the guide member, with a nose of the plunger member extending out of the guide member, each of the members being a single moulding of a plastics material, one or both members including one or more tongues which extend primarily in the direction of relative reciprocation of the members and are resiliently flexible transversely to that direction, each tongue engaging a cam or a tongue on the other member in such a manner that forces act on the tongues having components parallel to the direction of relative reciprocation of the members, in the sense which urges the members towards a limit of relative reciprocation at which the extension of the nose out of the guide member is greatest, and if the nose is displaced into the guide member and released, then the plunger member returns to the said limit.

4 Claims, 10 Drawing Figures

CATCHES

This invention relates to catches of the kind comprising a plunger member and a guide member, the plunger member being able to reciprocate in the guide member, with a nose of the plunger member extending out of the guide member, the members being continuously urged towards a limit of relative reciprocation at which the extension of the nose out of the guide member is greatest. Such catches commonly include a metal spring, and comprise a number of components which have to be made separately and then assembled.

In catches according to the present invention, the plunger member and the guide member are each a single moulding of a plastics material, one or both members including a tongue or tongues which extend primarily in the direction of relative reciprocation of the members and are resiliently flexible transversely to that direction, each tongue engaging a cam or a tongue in the other member in such a manner that forces act on the tongue or tongues having components parallel to the direction of relative reciprocation of the members in the sense which urges the members towards a limit of relative reciprocation at which the extension of the nose out of the guide member is greatest, and if the nose is displaced into the guide member and released, then the plunger member returns to the said limit.

Preferably one of the members includes a resilient detent which engages in a slot in the other member and prevents separation of the two members after assembly. In fact, it is then this detent which determines the limit of relative reciprocation referred to above.

The nose of the plunger member which extends out of the guide member may have various shapes, according to the function which the catch is intended to perform. If the catch is intended to be slammed shut, but only opened by operation of a handle, then the nose is rounded at one side and flat at the other, and the plunger member includes means for connection of an operating linkage. If, on the other hand, the catch is intended to be on a door which is pushed shut and pulled open, then the nose of the plunger member is equally rounded at both sides.

The accompanying drawings show two examples of catches embodying the present invention. In these drawings.

Figure 1:
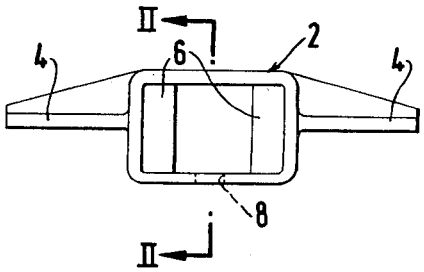
FIG. 1 is an end elevation of the guide member of the first catch.
Figure 2:
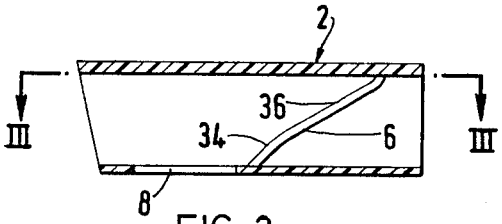
FIG. 2 is a section on the line II—II in FIG. 1.
Figure 3:
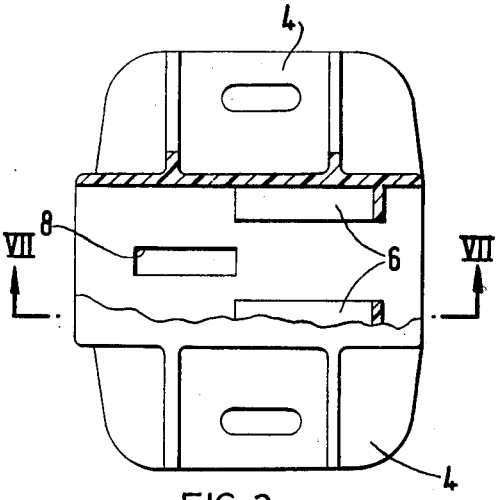
FIG. 3 is a plan, with part broken away on the line III—III in FIG. 2.

As shown in FIGS. 1 to 3, the guide member of the first catch, which is an integral moulding of a plastics material, e.g. nylon 6, consists of a body 2 in the form of a tube of rectangular cross-section with oblique ends, and two mounting lugs 4. Within the body 2, there are two cam surfaces 6, attached to the side walls of the body. In the bottom of the body is a longitudinal slot 8.

Figure 4:
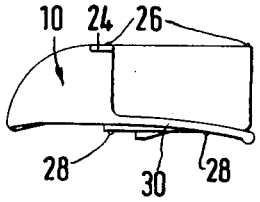
FIG. 4 is a side elevation of the plunger member of the first catch.
Figure 5:
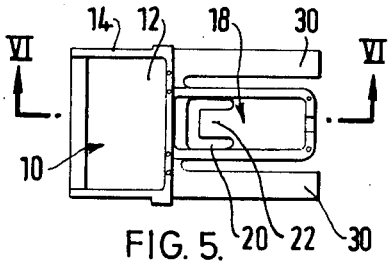
FIG. 5 is a plan of the plunger member.
Figure 6:
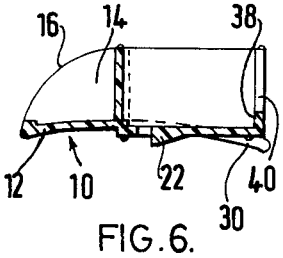
FIG. 6 is a section on the line VI—VI in FIG. 5.

As shown in FIGS. 4 to 6, the plunger member of the first catch is an integral moulding of a plastics material, e.g. acetal. The plunger member has a nose 10 in the form of a bottom wall 12 and two side walls 14, the side walls having rounded edges 16. The plunger member also has a tail 18, in the form of a rectangular box which, as shown in FIG. 5, is narrower than the nose 10, and is open at the top. In the bottom of the tail 18 there is a cut-out 20 defining a detent 22. As shown particularly in FIG. 6, this detent has a thickened end which projects below the plunger member in the unstressed condition.

There are small raised rubbing surfaces formed on the plunger member at 24, 26, and 28, and these make a good running fit within the body of the guide member, respectively engaging the side walls, top wall and bottom wall of the guide member.

The tail 18 lies between two resilient tongues 30, which extend rearwards from the bottom wall of the nose 10. The unstressed shape of these tongues is shown in FIG. 4, and the tongues have a small vertical dimension, so that they can flex resiliently in the up and down direction as seen in FIG. 4.

Figure 7:
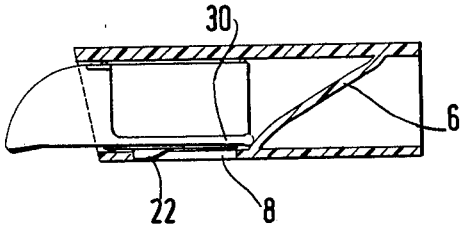
FIG. 7 shows the members assembled together, the guide member being in section on the line VII—VII in FIG. 3.

The catch is assembled by inserting the plunger member into the guide member from the left (as seen in FIG. 7) until the detent 22 has ridden over the bottom wall of the guide member and has engaged in the slot 8. In this relative position, the rear ends of the tongues 30 have engaged the cams 6, as shown in FIG. 7.

Figure 8:
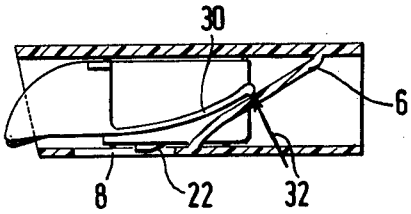
FIGS. 8 and 9 are views similar to FIG. 7, but showing the plunger member partly and completely displaced into the guide member.
Figure 9:
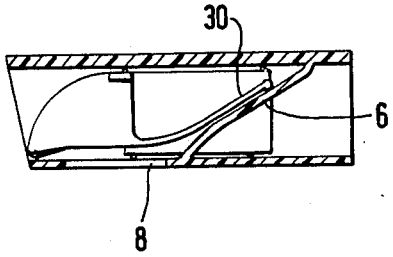

If, now, the plunger is urged to the right, as seen in FIG. 7 to 9, then the plunger becomes progressively displaced to the right, and this displacement is accompanied by flexing of the tongues 30, as they ride along the cam 6. Successive positions are shown in FIGS. 8 and 9. Because of the flexing of the tongues 30, opposed forces are set up at the point of inter-engagement of each tongue and cam. The force exerted by the cam on the tongue is indicated by the arrow 32 in FIG. 8. The friction between the two plastics materials is slight, and, therefore, the direction of the force 32 is substantially perpendicular to the surface of the cam 6. This direction depends upon the inclination of the cam 6, and in FIG. 8 it is apparent that the force 32 has a component upwards, at right angles to the direction of relative reciprocation of the plunger member and guide member, and also has a component horizontally to the left. This latter component is tending to restore the plunger member to the relative position shown in FIG. 7.

The magnitude of the force 32 depends upon the extent of flexing of the tongue 30. In order to provide a substantial component of force to the left when the plunger member is at or near its extreme left position, the cams 6 are not straight, but consist of two portions, shown most clearly in FIG. 2, the portion 34 being at an angle of about 40° to the direction of relative reciprocation of the members, and the portion 36 being at an angle of about 30° to the direction of relative reciprocation.

In the end wall 38 of the tail of the plunger member there is a slot 40 which can be used for connecting an operating linkage (not shown) to the plunger member.

The shape of the cams may be varied according to the relationship desired between restoring force and amount of displacement of the plunger member. For example, if the restoring force is to be uniform, then a curved cam is required. It is also possible to arrange for the force to rise progressively or to fall progressively.

As a converse to the arrangement shown in FIGS. 1 to 9, there may be a tongue or tongues on the guide member and a cooperating cam or cams on the plunger member.

Figure 10:
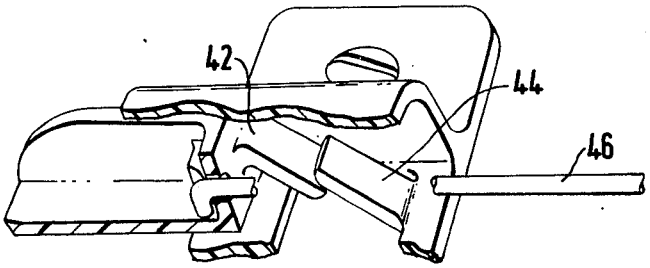
FIG. 10 is a perspective view, broken away, of a second catch.

In the second catch, shown in FIG. 10, the plunger member and the guide member each carry a pair of tongues 42 and 44 respectively. The gaps between the tongues of each pair accommodate an operating rod 46. In FIG. 10, only one tongue of each pair is visible. The two tongues are similar in flexibility and inclination. Such an arrangement tends to be a little more bulky than that shown in FIGS. 1 to 9. If there is no operating rod, as in a catch for a door to be pushed shut and pulled open, then in place of a pair of tongues there may be a single tongue centrally arranged.

We claim:

1. A two-piece plastic catch comprising an elongated plunger member and a centrally rectangular hollow open ended box-like guide member, the plunger member being complimentary to and able to reciprocate in the guide member, with a cam-shaped nose of the plunger member extending out of the guide member, each of the members being a single moulding of a plastics material, said plunger member including at least one tongue which extends primarily in the direction of relative reciprocation of the members and is resiliently flexible transversely to that direction, each tongue engaging cam means on the said guide member in such a manner that a force acts on the tongue of said plunger member having a component parallel to the direction of relative reciprocation of the members which urges the members towards a limit of relative reciprocation at which the extension of the nose out of the guide member is greatest, whereby if the nose is displaced into the guide member and is thereupon released then the plunger member returns to the said limit, said plunger member having a centrally located operating tail of less width than the nose, there being two of the said tongues carried on the plunger member at each side of the tail, the said cam means is constituted by two cams on the guide member with each of said cams being a web angularly disposed in the direction of reciprocation of the members and each extending inwardly in cantilever fashion from opposite side walls of said guide member in such a disposition that the free ends of the tongues are in opposition to and ride up said cams when the plunger member reciprocates into the guide member, and flange means for mounting said guide member on a workpiece.

2. A catch according to claim 1, in which said plunger member includes a resilient shouldered detent which engages in a slot in the said guide member and prevents separation of the two members after assembly, and thereby determines the said limit of relative reciprocations.

3. A catch according to claim 1, in which each of the cams consists of two portions, at different inclinations to the direction of relative reciprocation of the members.

4. A catch according to claim 1, in which the guide member is of nylon and the plunger member is of acetal.

* * * * *